US006390862B1

(12) United States Patent
Eichinger

(10) Patent No.: US 6,390,862 B1
(45) Date of Patent: May 21, 2002

(54) PUMP JET STEERING METHOD DURING DECELERATION

(75) Inventor: Charles H. Eichinger, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 09/716,312

(22) Filed: Nov. 20, 2000

(51) Int. Cl.[7] ..... B63H 21/22
(52) U.S. Cl. ..... 440/1; 440/38
(58) Field of Search ..... 440/1, 38, 40–43

(56) References Cited

U.S. PATENT DOCUMENTS

| | | | | |
|---|---|---|---|---|
| 4,031,844 A | | 6/1977 | Onal et al. | 115/12 |
| 5,193,478 A | | 3/1993 | Mardikian | 114/286 |
| 5,476,401 A | | 12/1995 | Peterson et al. | 440/42 |
| 5,755,601 A | | 5/1998 | Jones | 440/1 |
| 5,813,357 A | | 9/1998 | Watson | 114/145 |
| 5,894,087 A | | 4/1999 | Ohtuka et al. | 73/185 |
| 6,124,809 A | * | 9/2000 | Boudriau | 440/1 |
| 6,159,059 A | * | 12/2000 | Bernier et al. | 440/40 |
| 6,231,410 B1 | * | 5/2001 | Bernier et al. | 440/40 |
| 6,336,833 B1 | * | 1/2002 | Rheault et al. | 114/144 R |
| 2001/0036777 A1 | * | 11/2001 | Iida et al. | 440/84 |
| 2001/0051474 A1 | * | 12/2001 | Matsuda et al. | 440/1 |

* cited by examiner

*Primary Examiner*—Sherman Basinger
(74) *Attorney, Agent, or Firm*—William D. Lanyi

(57) ABSTRACT

A deceleration profile of a jet pump propulsion system affects the manually commanded deceleration of a boat by slowing the deceleration slightly in order to enhance steering capability on plane. In response to a manual engine speed command signal that commands a desired boat speed reduction, the engine control system slows the engine deceleration according to a preselected protocol or profile, and causes the engine speed to be maintained above the engine's idle speed for a predetermined time in order to allow a greater magnitude of water to pass through the jet pump of the propulsion system so that steering control is improved.

20 Claims, 3 Drawing Sheets

PUMP JET STEERING METHOD DURING DECELERATION

BACKGROUND OF THE INVENTION

1. Field of the Invention

The present invention is generally related to an engine control method for a marine propulsion system and, more specifically, to a method that controls the deceleration of an engine in a manner that improves the steering capability of a marine vessel.

2. Description of the Prior Art

Certain types of marine vessels use jet pumps, or water jets, with impellers as their primary marine propulsion system. For example, jet boats and personal watercraft use an internal combustion engine that rotates an impeller of a jet pump, in order to draw water from a body of water and expel the water rearwardly through a nozzle in order to provide propulsion for the marine vessel.

Certain jet pump propulsion systems are combined with a rudder or steering tabs which project downwardly from the marine vessel to assist in steering. However, these steering fins or rudders are generally undesirable because they are easily damaged if they strike submerged objects. In addition, steering fins or rudders can damage marine life or harm swimmers.

If the marine propulsion system is not provided with a steering fin or rudder, the water jet propulsion system can experience seriously reduced steering control when the throttle is rapidly reduced to idle speed because the steering capability of a water jet propulsion system is highly dependent on the magnitude of water flowing through the jet pump and its steering nozzle.

To improve this problem, certain manufacturers of jet pump marine propulsion systems utilize abnormally high engine idle speeds. In some cases, these higher idle speeds are permanently fixed at a magnitude which is greater than 20% of the maximum operating speed of the engine. This approach to a solution of the steering problem has numerous drawbacks, including potential movement of the watercraft even while in neutral, increased sand and debris ingestion by the impeller when in neutral, and possible difficulty in shifting from neutral to forward gear. Additionally, a high idle speed can waste a significant amount of fuel.

Some manufacturers of personal watercraft or jet boats introduce a throttle advance mechanism that is mechanically connected to the steering wheel. When the steering wheel is turned to a full right or full left position, the engine speed is increased to a magnitude that is approximately 150% to 170% of normal idle speed. While this technique improves the steering capability at low speeds, it can be troublesome when an operator attempts to maneuver the marine vessel at slow speeds.

U.S. Pat. No. 4,031,844, which issued to Onal et al on Jun. 28, 1977, describes a dual jet boat pump. A double suction, double volute pump for propelling a boat having each volute exhaust through a separate jet nozzle is described. The pump housing defines two intake passageways leading upward to either side of a double suction impeller. The housing further provides double volutes which receive water from each side of the double suction impeller and deliver it to dual nozzles thereby creating twin jets which may be employed to propel and control the boat. The double volutes each extend substantially full circle about the housing and terminate in elbows which lead to the nozzles. The nozzles are placed horizontally equidistant from the center line of the impeller shaft and are controlled by steering linkages to operate in unison. Reversing control gates may be operated either together for reversing or independently for slow speed steering.

U.S. Pat. No. 5,755,601 which issued to Jones on May 26, 1998, describes a brake system for a personal watercraft. A jet propelled watercraft has a brake which the driver of the watercraft can use to decelerate forward motion of the watercraft. The brake mechanism preferably includes a reverse gate which allows the watercraft steering to be consistent when the watercraft is accelerating or cruising with the reverse gate in full up position as when the watercraft is decelerating with the reverse gate in a full down or partially down position. The positioning of the reverse gate during operation of the watercraft is adjusted in accordance with the state of hand operated actuators for a forward throttle control mechanism and a brake control mechanism. Preferably, an electronic controller receives a signal from the control mechanisms and outputs a control signal that directs a servo motor to move a reverse gate cable or linkage to position the reverse gate. Forward thrust can be increased by proportionally closing the actuator for the forward thrust control mechanism. In addition, reverse thrust or braking thrust can be increased by proportionally closing the actuator for the brake control mechanism.

U.S. Pat. No. 5,813,357, which issued to Watson on Sep. 29, 1998, describes a jet ski steering and braking system. The system for steering and braking a jet ski watercraft uses flaps that may be independently or uniformly extended from a forward area of the watercraft hull. The flaps are located at or below the water line during operation.

U.S. Pat. No. 5,193,478, which issued to Mardikian on Mar. 16, 1993, describes an adjustable brake and control flap system for a watercraft. The system is used for trimming, steering, and braking a watercraft and includes a retractable plate or flap disposed on each lateral side of the hull of the watercraft. Each flap is extendible into the water, rearwardly in a continuously adjustable manner, and independently of the extension of the other flap. When the flap is fully extended, its angular position relative to the hull is also continuously adjustable independently of the angular positioning of the other flap. The flaps in their fully declined position act as powerful brakes for the watercraft. Differential extension of the flaps or differential adjustment of their relative angular positions on the two sides of the watercraft results in trimming and steering of the watercraft.

U.S. Pat. No. 5,476,401, which issued to Peterson et al on Dec. 19, 1995, describes a compact water jet propulsion system for a marine vehicle. The device provides an improved water jet propulsion system for a marine vehicle. The water jet propulsion system incorporates an unconventional and compact design including a short, steep, hydrodynamically designed inlet duct adapted for mounting to the surface of the vehicle hull and extending internally thereof, a water jet pump having an inlet end attached to the outlet end of the inlet duct, a motor for rotating the pump impeller, a driveshaft located completely outside of the flow path connecting the motor with the pump impeller, a flow passage for discharging accelerated flow received from the pump in a generally rearward direction, and a steering and reversing mechanism pivotally mounted about a substantially vertical axis to the aft portion of the vehicle hull for redirect accelerated flow received from the outlet nozzle so as to provide maneuvering capability to the vehicle.

U.S. Pat. No. 5,894,087, which issued to Ohtuka et al on Apr. 13, 1999, describes a speed sensor for a watercraft. The arrangement of a speed sensor on a personal watercraft shields the sensor from damage while simplifying the layout and arrangement of the sensor on the underside of the watercraft hull. The hull includes a pump chamber formed in part by a front wall. The speed sensor is attached to the wall with a portion of the sensor projecting below a housing of the sensor. A ride plate covers a lower opening of the pump chamber and fits about the sensor housing. In this location, the speed sensor does not interfere with the arrangement or operation of steering or trim mechanism used with a jet propulsion unit housed within the pump chamber. The speed sensor also is generally protected in this location and is not visible from the rear of the watercraft to improve the watercraft's aesthetics.

The patents described above are hereby explicitly incorporated by reference in the description of the present invention.

SUMMARY OF THE INVENTION

The present invention, in a particularly preferred embodiment, provides a method for controlling an engine of a marine propulsion system of a marine vessel. The method comprises the steps of monitoring an engine speed command signal. The engine speed command signal can be representative of a manually operated throttle control. The method further comprises the steps of determining a speed of the marine vessel and causing a speed of the engine to decelerate less than a speed indicated by the engine speed command signal when the engine speed command signal indicates a command for deceleration to a commanded speed, such as idle speed, which is less than a first preselected threshold. For example, if a marine propulsion system is being operated at a certain engine speed, and the marine vessel is moving at planing speed, and a manual engine speed command signal is received to quickly reduce the engine speed, the method of the present invention responds to that manual signal by decelerating the engine speed at a lesser rate or to an engine speed which is more than the indicated desired engine speed if the manually controlled engine speed command signal indicates a desired engine speed which is less than a first preselected threshold, typically equivalent to a speed slightly greater than an idle speed magnitude.

The causing step can apply a rate of deceleration that is generally equal to that which is indicated by the engine speed command signal, but limits the magnitude of decrease in engine speed to a result that is greater than the commanded engine speed. For example, if the manually controlled speed command signal indicates a desire to reduce the speed to idle speed, the causing step can reduce the speed at the normal deceleration rate, but to a minimum magnitude greater than idle speed. Alternatively, the causing step can apply a rate of deceleration which is less than that which is indicated by the engine speed command signal. In other words, if the manually controlled engine speed command signal indicates that the engine speed should be quickly reduced from its current operating speed to its idle speed in less than one second, for example, the rate of deceleration may be slowed to reduce the speed to idle speed in three or more seconds. With these two alternative embodiments, either the final reduced speed magnitude can be affected or the rate at which the commanded final speed magnitude is achieved can be affected. In both cases, the overall time duration from the occurrence of the speed command signal to the achievement of minimum speed is increased to maintain a longer period of improved steering control for the operator of the marine vessel.

In certain embodiments of the present invention, the causing step is only performed if the speed of the engine is greater than a second preselected threshold, such as planing speed, when the speed reduction command is received. The speed of the vessel can either be measured directly by a speedometer or indirectly as a function of engine speed and operating conditions. In certain embodiments of the present invention, the causing step can decrease the speed of the engine as a step function from an engine speed magnitude when the engine speed command signal initially indicates a command for deceleration to an engine speed which is generally equal to the engine speed command signal. This step function can comprise one or more individual and discrete steps. The marine propulsion system can comprise a jet pump and can be incorporated within a personal watercraft or a jet boat.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
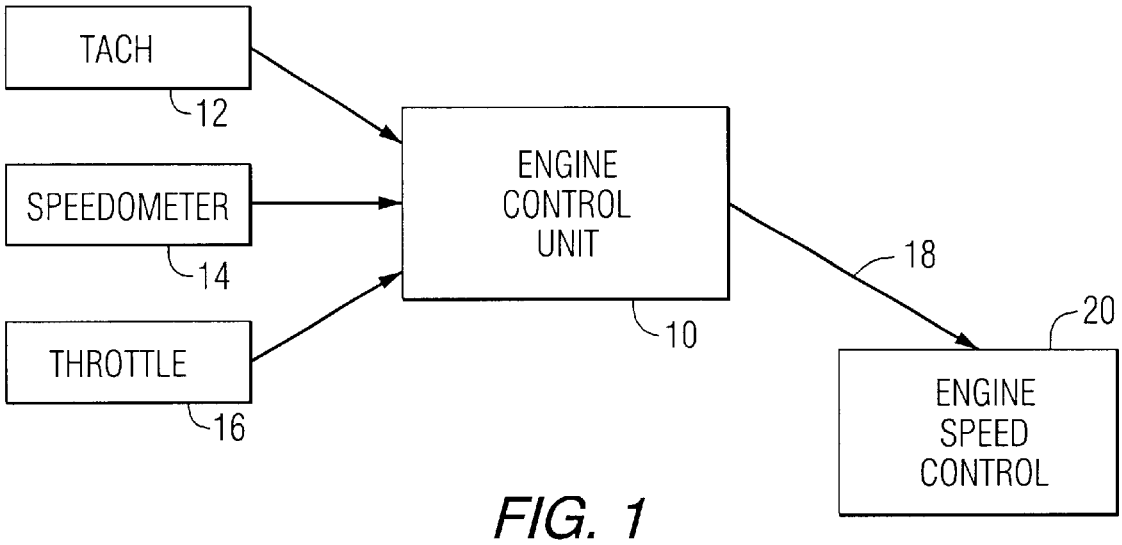
FIG. 1 is a highly simplified schematic of an engine control system that can implement the present invention.

Throughout the description of the preferred embodiment of the present invention, like components will be identified by like reference numerals.

In FIG. 1, an engine control unit 10 is provided with input information from a tachometer 12, a speedometer 14, and a throttle controller device 16 which is manually controlled by the operator of a marine vessel. The tachometer 12 provides information to the engine control unit 10 regarding the operating speed of the engine. The speedometer 14 provides information relating to the actual speed of the marine vessel relative to the body of water in which it is operated. The throttle 16 represents the manual movement of a throttle control mechanism, such as a throttle handle or a pistol grip handle of a personal watercraft. The engine control unit 10 receives the inputs described above and provides a command signal, on line 18, to an engine speed control mechanism 20 which can be a throttle plate of a carburetor or air intake manifold or, alternatively, can be a direct fuel injection system in which the speed control provided on line 18 directly controls the rate at which fuel is provided to the cylinders of an engine. FIG. 1 is a highly simplified schematic representation of a system that can perform the method of the present invention.

Figure 2:
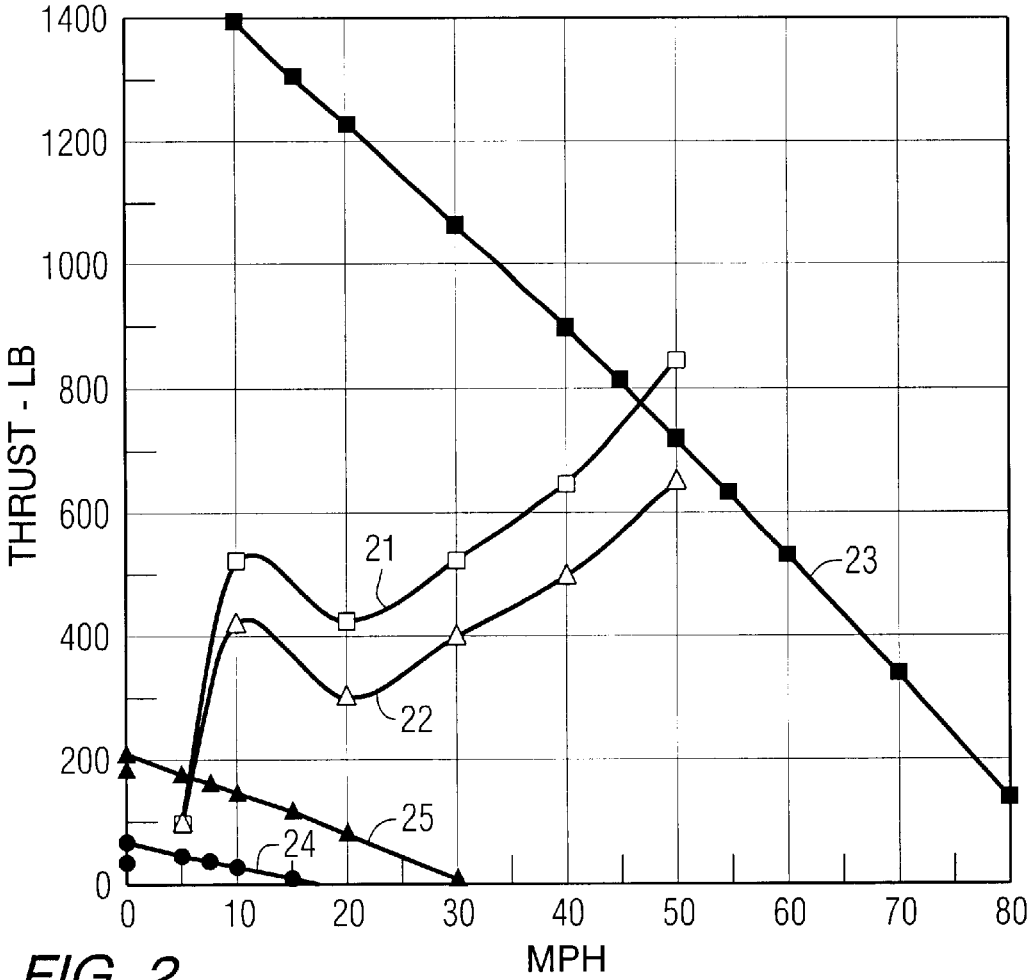
FIG. 2 shows the drag profiles of two exemplary boats along with thrust curves for three engine speeds.

FIG. 2 is a graphical representation of the relationship between thrust, measured in pounds of force, and the speed of a marine vessel, measured in miles per hour. Line 21 in FIG. 2 represents the thrust needed to overcome the drag of a marine vessel, such as a 18 foot jet boat with a heavy load. Line 22 represents the drag of the same boat with a light load. It should be understood that lines 21 and 22 in FIG. 2 are calculated and do not represent actual empirical data. As such, the absolute magnitudes of the two lines, 21 and 22, at various boat speeds, can vary under different circumstances. However, these two lines are sufficiently representative of the drag characteristics of marine vessels to allow the basic concepts of the present invention to be described. Line 23 represents the thrust that can be provided by a 200 HP engine at wide open throttle (WOT). Line 24 represents the thrust that can be provided, for various boat speeds, by the same engine at idle speed. Line 25 represents the thrust, at various boat speeds, when the engine is operated at 2,000 RPM for the purpose of providing steering augmentation. The location where lines 24 and 25 intersect the drag characteristic lines, such as lines 21 or 22, indicate the effective thrust provided at those engine speeds. It can be seen that line 25 provides significantly higher thrust at essentially no increase in speed.

With continued reference to FIG. 2, it can be seen that both lines, 21 and 22, represent a high rate of increase in drag up to approximately 10 miles per hour. At these low speeds, the marine vessel is not on plane. Above 10 miles per hour, the transition phase of both lines, 21 and 22, indicate a decrease in drag as the boat achieves planing speed between 10 and 20 miles per hour. Above 20 miles per hour, the boat is on plane and the drag increases at a function of boat speed at a rate which is less than the corresponding rate of increase in drag below 10 miles per hour. As can be seen in FIG. 2, a decrease in engine speed from planing speed down to 2,000 RPM, as represented by line 25, would result in the marine vessel moving at a relatively low velocity of slightly greater than 5 miles per hour, but with improved steering control compared to a corresponding decrease down to idle speed. If, on the other hand, the engine speed is reduced to normal idle speed, as indicated by line 24, steering capability is significantly diminished.

Figure 3:
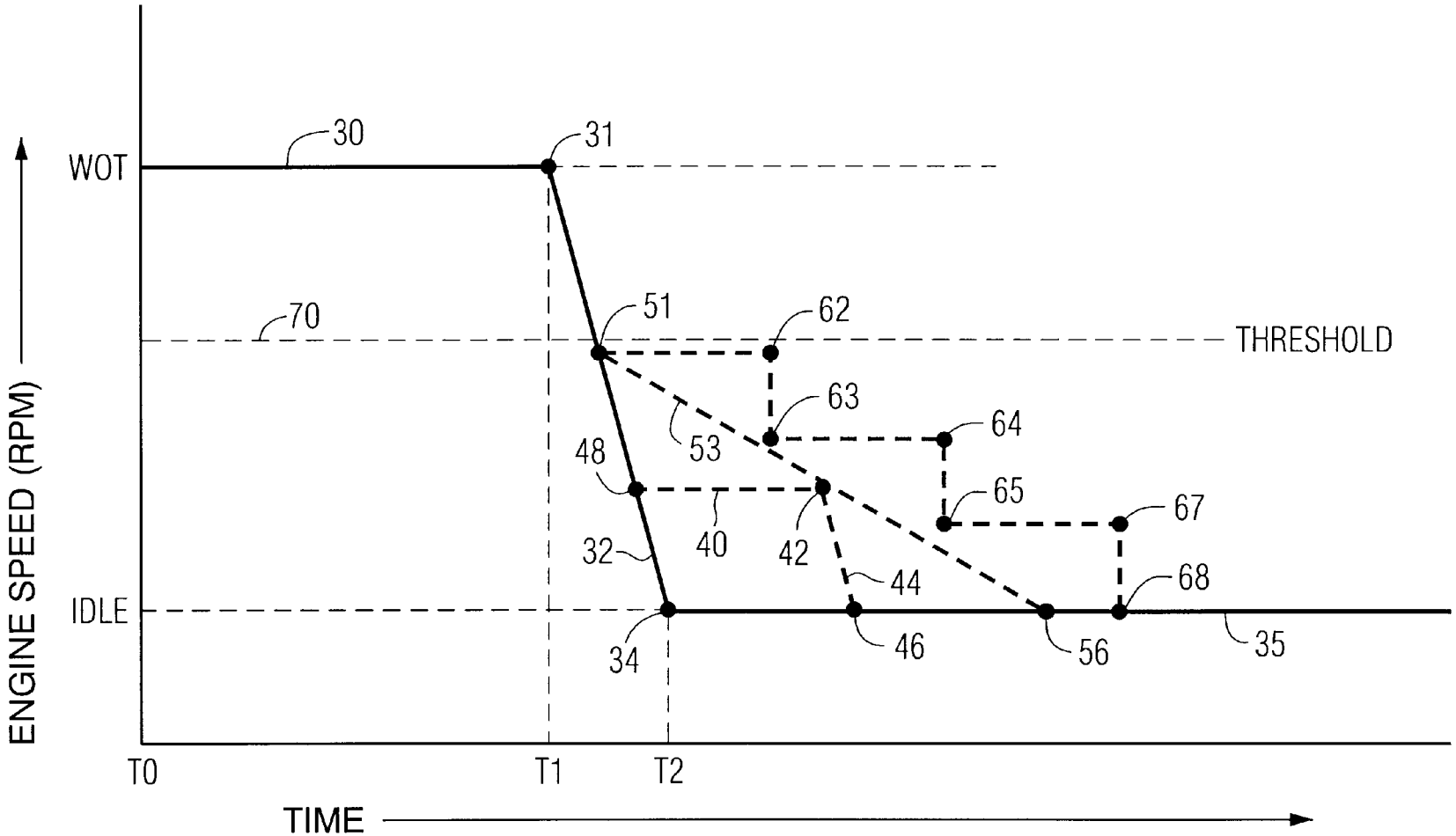
FIG. 3 shows a chronological profile of engine speed plotted according to several alternative embodiments of the present invention.

FIG. 3 is a graphical representation of several possible chronologies of engine speed changes. In all of the examples that will be described below, a maximum speed deceleration command is received at time $T_1$. This means that a marine vessel is operating with its engine speed at wide open throttle (WOT) 30 from time $T_0$ to time $T_1$. Then, a manual engine speed control signal, such as a movement of a throttle level, occurs at point 31. Under normal circumstances, the engine speed would be quickly reduced, as represented by the solid line 32 between points 31 and 34. As a result, the engine speed at time $T_2$ is generally equal to idle speed. The engine then continues to operate at idle speed, as represented by solid line 35. The solid lines, 30, 32, and 35, in FIG. 3 represent the change in engine speed resulting from a manual deceleration command occurring at point 31 and at time $T_1$.

With continued reference to FIG. 3, one embodiment of the present invention responds to the manual deceleration command at point 31 by decelerating the engine to an engine speed at point 48, as represented by dashed line 40, which is greater than idle speed as represented in FIG. 3. That idle speed would be maintained for a preselected period of time, represented by the length of horizontal dashed line 40, until point 42 when the engine speed would be further reduced as represented by dashed line 44 to idle speed at point 46. As represented by dashed lines 40 and 44, this embodiment of the present invention decreases the engine speed at a rate equal to the normal rate of deceleration until the engine speed reaches that represented by point 48 and dashed line 40. At that speed, further deceleration is halted until a preselected period of time elapses, at point 42, when the engine speed is further reduced. The delay in the reduction of engine speed to idle speed, as represented by dashed lines 40 and 44 and points 42, 46, and 48, allow a slightly elevated operating speed which facilitates steering during the deceleration process. Point 42 can be determined as a function of elapsed time, such as five seconds, or as a function of boat speed, such as the reduction of boat speed to a speed below 5 MPH.

An alternative embodiment of the present invention would respond to the manual speed reduction command signal by decelerating at a slower rate for at least a portion of the total deceleration procedure. For example, when the manual deceleration command is received at point 31, the speed of the engine would be decreased until point 51 and then a reduced deceleration rate, as represented by dashed line 53, would be followed until idle speed is achieved at point 56.

With continued reference to FIG. 3, an alternative embodiment of the present invention can comprise the reduction in engine speed in a series of steps. For example, when the manually controlled engine speed command signal is received at time $T_1$, the engine speed can be reduced to point 51 and then held constant for a period of time, to point 62 at which time the engine speed is again incrementally reduced to point 63, and so on. In the example shown in FIG. 3, this procedure would be repeated by holding the engine speed constant from point 63 to point 64 and then reducing it to point 65. The final step in the series of steps would comprise the holding of the engine speed constant from point 65 to point 67 and then finally reducing it to idle speed at point 68. It should be understood that the step function described above and illustrated by points 51, 62, 63, 64, 65, 67, and 68 can comprise any number of steps. The engine speed magnitude at each step and the duration of each step can be determined as a function of time or boat speed.

In all of the embodiments of the present invention, the deceleration of the engine is slowed so that idle speed is not achieved as quickly as would normally occur in response to a manually provided engine speed command signal.

With continued reference to FIG. 3, certain embodiments of the present invention would only affect the rate of deceleration if the commanded lower speed is less than a preselected threshold, such as that identified by reference numeral 70 in FIG. 3. In all likelihood, the threshold magnitude 70 would be lower than that indicated in FIG. 3, but for purposes of clarity of illustration, the threshold 70 is shown as representing a magnitude greater than would normally be used. In a typical application of the present invention, the threshold 70 would be approximately two times the magnitude of the engine's idle speed. Any manual command to reduce the engine speed to a magnitude lower than the threshold 70 would initiate the delayed deceleration described above and represented by the dashed lines in FIG. 3. For example, a manual command to reduce the engine speed from wide open throttle (WOT) to 80% of wide open throttle (WOT) would not initialize the control method of the present invention. However, a command to reduce the speed from wide open throttle (WOT) to 105% of idle speed, and below the threshold 70, would initiate the present invention.

Another embodiment of the present invention could incorporate a second threshold magnitude which represents a speed that the engine must be operating at prior to the manual deceleration command in order for the present invention to be activated. In other words, if the engine is not operating above the second threshold value, a deceleration command received from the operator would be followed normally with no delay and no implementation of the control method of the present invention. Since the purpose of the present invention is to facilitate steering when the operator rapidly reduces engine speed from a planing speed to idle speed, certain embodiments of the present invention could place two restrictions on the initiation of the present invention. First, the engine must be initially operating at a relatively high engine speed, above the second threshold, and the manual deceleration command must indicate a desired lower speed that is below the first threshold. These restrictions help a marine vessel operator to maneuver the marine vessel at low speeds, accelerating and decelerating, without adversely affecting the control of the marine vessel by inappropriately interfering with the operator's commands. Certain circumstances do not warrant the application of the control method of the present invention and the use of these thresholds facilitate the selection of those circumstances. In FIG. 3, a single line 70 is used to represent both thresholds, but it should be understood that in most applications, the second threshold would be significantly higher than the first threshold.

Figure 4:
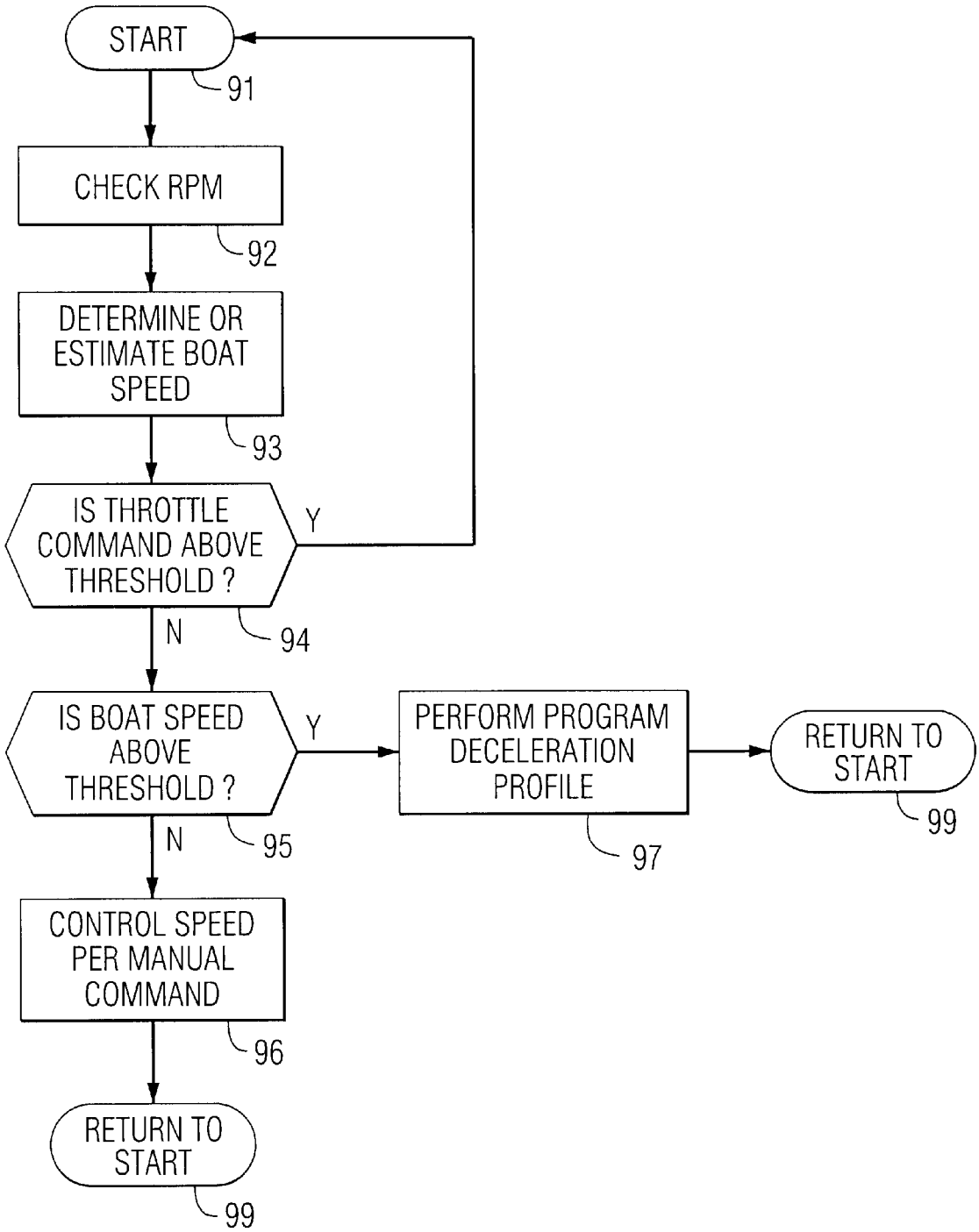
FIG. 4 is an exemplary flow chart that can be used to implement the method of the present invention.

FIG. 4 is an exemplary flowchart showing the steps that software within the engine control unit 10 could implement to perform the steps of the present invention. Beginning at a starting point 91, the control program would first determine the engine RPM at functional block 92 and either measure or calculate the boat speed at functional block 93. The RPM can easily be measured with a tachometer. The boat speed can either be measured directly by a speedometer or calculated as a function of the engine speed history and the boat's characteristics. In functional block 94 the control program determines if the throttle command is above a threshold. If it is, no further action is required and the program returns to start. If the throttle control is below the threshold the program advances to functional block 95 and determines whether or not the boat speed is above a threshold magnitude. In essence, this determination is based on the need to know whether or not the boat is operating at planing speed or, alternatively, is operating at a speed less than planing speed. If the boat is operating below planing speed, there is no urgent need to implement the present invention. However, if the boat speed is above planing speed, the present invention can be significantly helpful in improving steering capability as the boat or personal watercraft is rapidly decelerated. Based on the inquiry at functional block 95, the program either proceeds to functional block 96 or 97.

If the boat speed is determined to be above the threshold in functional block 95, then the preprogramed deceleration profile is performed as indicated in function block 97. This profile can be anyone of the profiles represented by dashed lines in FIG. 3 or any other profile that delays the deceleration of engine speed. If the interrogation at functional block 95 is negative, the engine deceleration is controlled in conformance with the precise engine speed command signal manually provided by the operator of the boat. The control program then returns to start.

As described in detail above, the method of the present invention continually monitors the speed of the boat and the engine speed command signal provided by the operator. The boat speed is monitored to determine whether or not the boat is operating at a significantly high speed to warrant the application of the present invention in the event of a deceleration command. If the boat is operating at or above planing speed, the deceleration method of the present invention is initiated and the rate of deceleration if affected as described above in one of several ways. However, if the deceleration command is merely a slight reduction in engine speed and not a drastic reduction to idle speed, the present invention may not be instituted because the commanded speed is not less than a first threshold which is moderately above idle speed.

The purpose of the present invention is to maintain steering capability of the marine vessel as it decelerates. If the throttle control is allowed to reduce the engine speed to idle speed, which is typically 1000 RPM or less, many jet pump propulsion systems do not experience sufficient water flow through their nozzles to allow the operator to adequately steer the vessel. By maintaining the reduced engine speed at or above an increased idle speed, of 2000 RPM or greater, this steering capability is maintained even through the speed of the watercraft is sufficiently reduced to allow the operator to bring the boat to a normal stop.

With reference to FIG. 1, it can be seen that the engine control unit 10 receives inputs from a tachometer 12, a speedometer 14, and a manual throttle control 16. The software contained within the engine control unit 10 then determines an appropriate rate of deceleration of the engine which is provided as a signal line 18 to an engine speed control device 20. Although the present invention has been described with respect to a software program within a microprocessor of the engine control unit 10, it should be understood that the dashed line deceleration protocols illustrated in FIG. 3 could also be implemented through mechanical means, such as a dashed pot or other deceleration delaying component. As described in FIG. 2, every marine vessel has a minimum and maximum drag profile, as represented by lines 22 and 21, and the selection of engine speed determines the steady state boat speed that will result. In FIG. 2, the thrust of an increased idle speed 25 of approximately 2000 RPM was used in an exemplary manner to illustrate one potential embodiment of the present invention. However, other increased idle speeds can also be used for these purposes. The difference in thrust provided by the normal idle speed 24 and the increased engine speed 25 results in a significant increase in thrust provided to the boat. Although the boat speed is not increased dramatically, steering control is enhanced significantly.

FIG. 3 shows several different deceleration profiles represented by dashed lines. However, many of the embodiments of the present invention use speed that is above idle speed, in response to a deceleration command, and eventually reduce that engine speed to idle speed after a preselected time period. It should be understood that, instead of a preselected time period, the method of the present invention could monitor boat speed continually at the lower engine speed following a deceleration and, when the boat speed reduces below a third threshold, the engine speed can be further reduced to idle speed.

Although the present invention has been described with particular detail and illustrated with significant specificity in order to describe certain embodiments, it should be understood that alternative embodiments are also within its scope.

I claim:

1. A method for controlling an engine of a marine propulsion system of a marine vessel, comprising the steps of:

monitoring an engine speed command signal;

determining a speed of said marine vessel; and causing a speed of said engine to decelerate at a preselected rate which is less than a deceleration rate indicated by said engine speed command signal when said engine speed command signal indicates a command for deceleration to a commanded speed which is less than a first preselected threshold.

2. The method of claim 1, wherein:

said causing step applies a rate of deceleration generally equal to that which is indicated by said engine speed command signal and limits a decrease in said speed of said engine to a magnitude which is greater than said commanded speed.

3. The method of claim 1, wherein:

said causing step applies a rate of deceleration which is less than that which is indicated by said engine speed command signal.

4. The method of claim 1, wherein:

said causing step is performed only if said speed of said engine is greater than a second preselected threshold.

5. The method of claim 1, wherein:

said speed of said vessel is measured directly by a speedometer.

6. The method of claim 1, wherein:

said speed of said vessel is determined indirectly as a function of said speed of said engine.

7. The method of claim 1, wherein:

said speed of said engine is used as a direct indicator of said speed of said vessel.

8. The method of claim 1, wherein:

said causing step decreases said speed of said engine as a step function deceleration from a first engine speed magnitude, when said engine speed command signal initially indicates a command for deceleration, to a second engine speed magnitude which is generally equal to said engine speed command signal.

9. The method of claim 8, wherein:

said step function deceleration comprises more than one speed magnitude step.

10. The method of claim 1, wherein:

said marine propulsion system comprises a jet pump.

11. A method for controlling an engine of a marine propulsion system of a marine vessel, comprising the steps of:

monitoring an engine speed command signal;

determining a speed of said marine vessel, said marine propulsion system comprising a jet pump; and causing a speed of said engine to decelerate at a preselected rate which is less than a deceleration rate indicated by said engine speed command signal when said engine speed command signal indicates a command for deceleration to a commanded speed which is less than a first preselected threshold, said causing step applies a rate of deceleration generally equal to that which is indicated by said engine speed command signal and limits a decrease in said speed of said engine to a magnitude which is greater than said commanded speed.

12. The method of claim 11, wherein:

said causing step is performed only if said speed of said engine is greater than a second preselected threshold.

13. The method of claim 11, wherein:

said speed of said vessel is measured directly by a speedometer.

14. The method of claim 11, wherein:

said speed of said vessel is determined indirectly as a function of said speed of said engine.

15. The method of claim 11, wherein:

said speed of said engine is used as a direct indicator of said speed of said vessel.

16. The method of claim 11, wherein:

said causing step decreases said speed of said engine as a step function deceleration from a first engine speed magnitude when said engine speed command signal initially indicates a command for deceleration to a second engine speed magnitude which is generally equal to said engine speed command signal.

17. The method of claim 16, wherein:

said step function deceleration comprises more than one speed magnitude step.

18. A method for controlling an engine of a marine propulsion system of a marine vessel, comprising the steps of:

monitoring an engine speed command signal;

determining a speed of said marine vessel, said marine propulsion system comprising a jet pump; and causing a speed of said engine to decelerate at a preselected rate which is less than a deceleration rate indicated by said engine speed command signal when said engine speed command signal indicates a command for deceleration to a commanded speed which is less than a first preselected threshold, said causing step being performed only if said speed of said engine is greater than a second preselected threshold for a preselected period of time.

19. The method of claim 18, wherein:

said causing step applies a rate of deceleration generally equal to that which is indicated by said engine speed command signal and limits a decrease in said speed of said engine to a magnitude which is greater than said commanded speed.

20. The method of claim 18, wherein:

said speed of said vessel is determined indirectly as a function of said speed of said engine.

* * * * *